US006555040B1

(12) United States Patent
Lienau

(10) Patent No.: US 6,555,040 B1
(45) Date of Patent: Apr. 29, 2003

(54) METHOD OF MAKING PRESSED EARTH BLOCK MACHINE

(76) Inventor: David Lienau, P.O. Box 774, Pearce, AZ (US) 85625

( * ) Notice: Subject to any disclaimer, the term of this patent is extended or adjusted under 35 U.S.C. 154(b) by 69 days.

(21) Appl. No.: 09/954,902

(22) Filed: Sep. 18, 2001

Related U.S. Application Data

(63) Continuation of application No. 09/275,172, filed on Mar. 24, 1999, now Pat. No. 6,302,675.

(51) Int. Cl.[7] ..... B28B 3/00; B28B 13/02; B28B 13/06

(52) U.S. Cl. ..... 264/109; 264/239; 264/297.1; 264/334

(58) Field of Search ..... 264/109, 239, 264/297.1, 334; 425/352

(56) References Cited

U.S. PATENT DOCUMENTS

| | | | | | |
|---|---|---|---|---|---|
| 661,864 | A | * | 11/1900 | Graves | 425/169 |
| 1,465,608 | A | | 8/1923 | McCoy | |
| 1,872,522 | A | | 8/1932 | Stuckey | |
| 1,967,608 | A | | 7/1934 | Clingan | 25/103 |
| 1,997,813 | A | * | 4/1935 | Cullen | 425/351 |
| 2,436,176 | A | * | 2/1948 | Novello | 425/260 |
| 2,675,584 | A | * | 4/1954 | Fienberg et al. | 425/324.1 |
| 3,154,812 | A | * | 11/1964 | Haller | 425/78 |
| 3,191,232 | A | * | 6/1965 | Haller | 425/415 |
| 3,764,244 | A | * | 10/1973 | Hurley et al. | 425/352 |
| 3,887,685 | A | | 6/1975 | Stelzmuller | 425/260 |
| 4,098,865 | A | | 7/1978 | Repasky | 264/333 |
| 4,201,530 | A | | 5/1980 | Vogt | 425/260 |
| 4,563,144 | A | | 1/1986 | Rose | 425/166 |
| 4,813,818 | A | * | 3/1989 | Sanzone | 425/447 |
| 4,818,201 | A | * | 4/1989 | Howard | 425/405.2 |
| 4,853,180 | A | * | 8/1989 | Howard | 425/78 |
| 5,037,287 | A | * | 8/1991 | Hirai | 264/109 |
| 5,074,774 | A | * | 12/1991 | Nose et al. | 264/40.4 |
| 5,589,124 | A | | 12/1996 | Woolford | 264/157 |
| 5,629,033 | A | | 5/1997 | Lienau | 425/353 |
| 5,648,033 | A | | 7/1997 | Bogue | 264/109 |
| 5,653,926 | A | | 8/1997 | Bogue | 264/120 |
| 5,775,047 | A | * | 7/1998 | Jensen | 52/606 |
| 5,885,496 | A | * | 3/1999 | Beane et al. | 264/113 |
| 5,885,625 | A | * | 3/1999 | Beane et al. | 264/109 |

FOREIGN PATENT DOCUMENTS

| | | | | |
|---|---|---|---|---|
| WO | WO 8606774 A1 | * | 11/1986 | B28B/7/24 |

* cited by examiner

*Primary Examiner*—Stephen J. Lechert, Jr.
(74) *Attorney, Agent, or Firm*—Frank J. Catalano

(57) ABSTRACT

A block is made from loose earth. A press foot in a breech is raised to a first level even with the top of the breech. The press foot is lowered to a second level to receive a volume of loose earth from a feed drawer. The feed drawer is withdrawn to screed excess loose earth from the top of the breech. A bucking foot is lowered to close the breech. The press foot is raised to a third level to compress the loose earth into a block. The bucking foot is raised to permit vertical ejection of the block into the path of the feed drawer. Upon again raising the press foot to the first level, a previously-made block is simultaneously raised. Upon again moving the feed drawer over the breech, the previously-made block is simultaneously pushed aside.

10 Claims, 7 Drawing Sheets

METHOD OF MAKING PRESSED EARTH BLOCK MACHINE

This application is a continuation of application Ser. No. 09/275,172, filed Mar. 24, 1999 U.S. Pat. No. 6,302,675.

BACKGROUND OF THE INVENTION

This invention relates generally to machines for the manufacture of building block and more particularly concerns a machine and a method for making blocks of pressed earth.

In my earlier U.S. Pat. No. 5,629,033, a pressed earth block machine suitable for the manufacture of flat-surfaced blocks was disclosed. However, the invention disclosed therein is not suitable for the manufacture of blocks having three-dimensional surfaces in the orthogonally oriented sides of the blocks. In some building applications, it is desirable that the blocks have a tongue and groove configuration in both their lateral sides for maximum strength between laterally adjacent blocks and in their upper and lower surfaces for maximum strength between vertically adjacent blocks. A three dimensional configuration in orthogonal faces presents new problems in the pressing of the block in the breech, the ejection of the block from the breech and the transfer of the ejected block out of the path of the breech without causing damage to the block or its three dimensional contours. These problems are in addition to the normal requirements in speed of manufacture of the blocks, consistency of size and density of the blocks and simplicity of operation and maintenance of the machine.

It is, therefore, an object of this invention to provide a machine and method for manufacturing pressed earth blocks which make pressed earth blocks of constant density and depth. Another object of this invention is to provide a machine and method for manufacturing pressed earth blocks which facilitate the rapid production of uniform earth blocks. Yet another object of this invention is to provide a machine and method for manufacturing pressed earth blocks which produce blocks which are tongued-and-grooved in block surfaces that are orthogonal to each other.

SUMMARY OF THE INVENTION

In accordance with the invention, a method is provided for making a block from pressed earth. A press foot is raised in a breech to a first level even with an open upper end of the breech. A feed drawer having an open lower end and filled with granular material or loose earth is moved laterally across a planar surface into registration over the breech. The press foot is then lowered to a second level in the breech to receive a volume of the loose earth from the feed drawer into the breech. The feed drawer is withdrawn laterally across the planar surface out of registration with the breech to remove or screed the excess loose earth from above the open upper end of the breech. A bucking foot is then lowered to close the upper end of the breech. The press foot is raised to a third level in the closed breech to compress the loose earth in the breech into a block. The bucking foot is then raised to a level higher than the top of the feed drawer to permit vertical ejection of the block from the open upper end of the breech into the lateral path of the feed drawer. Upon repetition of the first step of raising the press foot to the first level, a previously-made block will be simultaneously raised into the lateral path of the feed drawer. Upon repetition of the second step of moving the feed drawer laterally into registration over the breech, the previously-made block will be simultaneously pushed out of the path of the bucking foot.

Preferably, when the feed drawer is fully withdrawn laterally across the planar surface out of registration with the breech, the feed drawer will be aligned under a hopper storing loose earth and additional loose earth will be dispensed from the hopper to refill the feed drawer.

In making vertically and laterally tongue-and-grooved blocks, the press foot and the bucking foot have complementary three dimensional upper and lower surfaces, respectively, and the breech has complementary three dimensional opposite side surfaces. Preferably, the step of moving the feed drawer and simultaneously pushing the previously-made block is performed by abutment of a three dimensional face of the previously-made block with a leading face of the feed drawer.

The machine for making block has an orthogonal breech aligned on a Z-axis and open upper and lower ends. The press foot is aligned below the breech for vertical reciprocal movement along the Z-axis within the breech. The feed drawer is aligned laterally of the breech for horizontal reciprocal movement along a Y-axis and has an open lower end for dispensing loose earth into the breech. The bucking foot is aligned above the breech for vertical reciprocal movement along the Z-axis to open and close the upper end of the breech. A hydraulic cylinder moves the feed drawer across a surface coplanar with the feed drawer open lower end into and out of registration with the breech. A second hydraulic cylinder moves the bucking foot into and out of abutment with the open upper end of the breech. A third hydraulic cylinder raises the press foot to a first level even with the open upper end of the breech when the feed drawer is out of registration with the breech, lowers the press foot to a second level in the breech to receive a volume of loose earth when the feed drawer is in registration with the breech and raises the press foot to a third level within the breech when the bucking foot is in abutment with the upper end of the breech to compress the loose earth in the breech against the bucking foot and form a block of pressed earth.

Preferably, the breech is substantially rectangular in the X-Y plane with two-dimensional surfaces in its Y-Z side walls and complementary three-dimensional surfaces in its X-Z side walls to provide the lateral tongue-and-groove of the block. All preferably, the press foot and the bucking foot have complementary three-dimensional surfaces in their upper and lower X-Y walls, respectively, to provide the vertical tongue-and-groove of the block.

Preferably, the machine further includes a hopper storing loose earth and aligned above the feed drawer when the feed drawer is out of registration with the breech. An open upper end of the feed drawer admits loose earth into the feed drawer from the hopper. The feed drawer has a trailing plate coplanar with its open upper end for closing the hopper when the feed drawer is in registration with the breech.

It is specially preferred that the feed drawer has a fixed wall with a lower edge notched to pass over the three dimensional surface of the press foot and push an already made block out of registration with the breech during forward motion of the feed drawer and a hinged wall following the fixed wall with a level lower edge for screeding along the open upper end of the breech during rearward motion of the feed drawer and for swinging clear above the three dimensional surface of the press foot during forward motion of the feed drawer.

BRIEF DESCRIPTION OF THE DRAWINGS

Other objects and advantages of the invention will become apparent upon reading the following details description and upon reference to the drawings in which.

Figure 1:
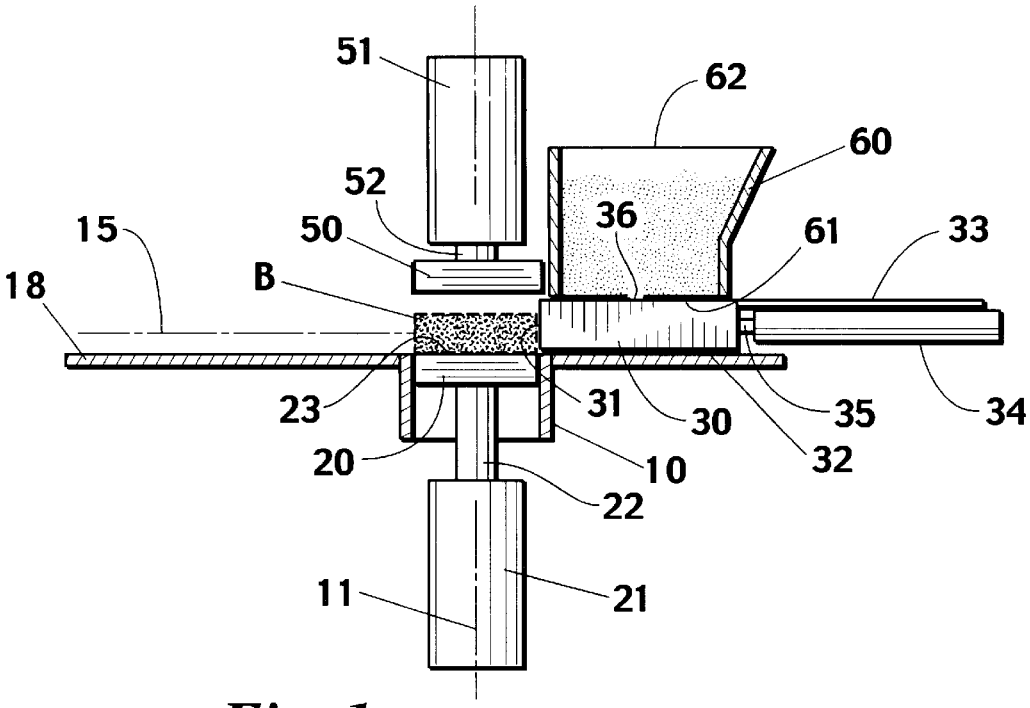
FIGS. 1 through 8 are side elevation general arrangement drawings illustrating a preferred embodiment of the pressed earth block machine and the sequential steps of the method of making pressed earth blocks.
Figure 2:
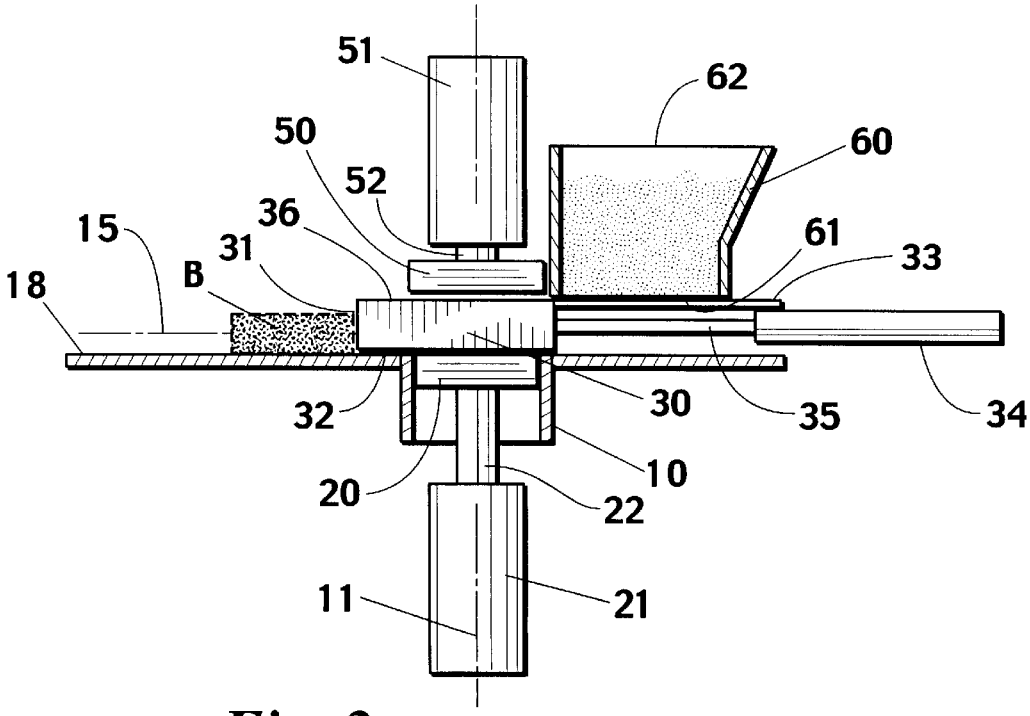

While the invention will be described in connection with a preferred embodiment and method, it will be understood that it is not intended to limit the invention to that embodiment and method. On the contrary, it is intended to cover all alternatives, modifications and equivalents as may be included within the spirit and scope of the invention as defined by the appended claims.

DETAILED DESCRIPTION

Turning first to FIGS. 1 through 8, the general arrangement of the pressed earth block machine and the method by which the blocks are made is illustrated. The major components of the machine are a breech 10 which defines the side walls of the block, a press foot 20 which defines the bottom surface of the block, a feed drawer 30 which delivers earth to the breech 10 and screeds the surface surrounding the breech on withdrawal, a bucking foot 50 which defines the upper face of the block, a hopper 60 which supplies earth to the feed drawer 30 and an hydraulic system 70 which drives the press foot 20, the feed drawer 30 and the bucking foot 50.

The breech 10 is aligned on a Z-axis 11 and is substantially rectangular in the X-Y plane. The breech 10 is open at its upper and lower ends and a planar surface 18 extends outwardly from the upper perimeter of the breech 10. The press foot 20 is reciprocally driven by an hydraulic cylinder 21 having its shaft 22 extending upwardly to the bottom of the press foot 20. The press foot 20 moves along the Z-axis 11 within the breech 10. The feed drawer 30 has a front end 31 and an open bottom 32. A plate 33 coplanar with the top of the drawer 30 extends rearwardly from the drawer 30. The drawer is reciprocally driven along the Y-axis 15 by a second hydraulic cylinder 34 having its shaft 35 connected to the rear of the feed drawer 30. The drawer 30 also has an open upper end 36. The bucking foot 50 is reciprocally driven along the Z-axis 11 by a third hydraulic cylinder 51 having its shaft 52 connected to the top of the bucking foot 50. The hopper 60 is mounted above the feed drawer 30 when the feed drawer is in its fully withdrawn position. The hopper 60 has an open bottom 61 and receives loose earth through an open top 62.

Figure 3:
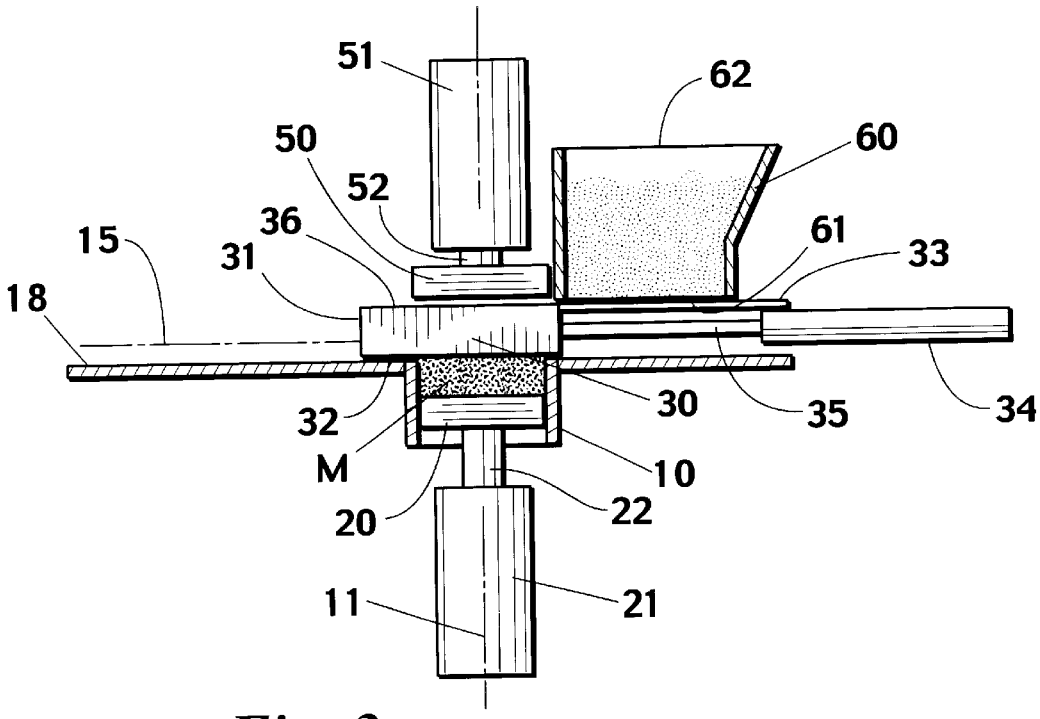
Figure 4:
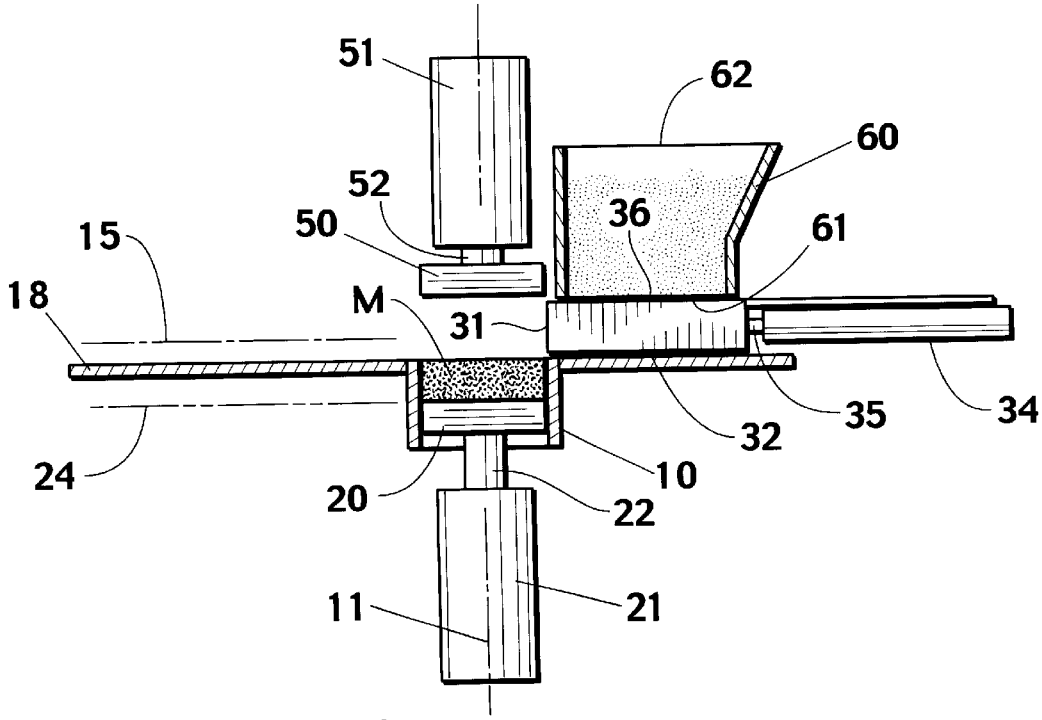
Figure 5:
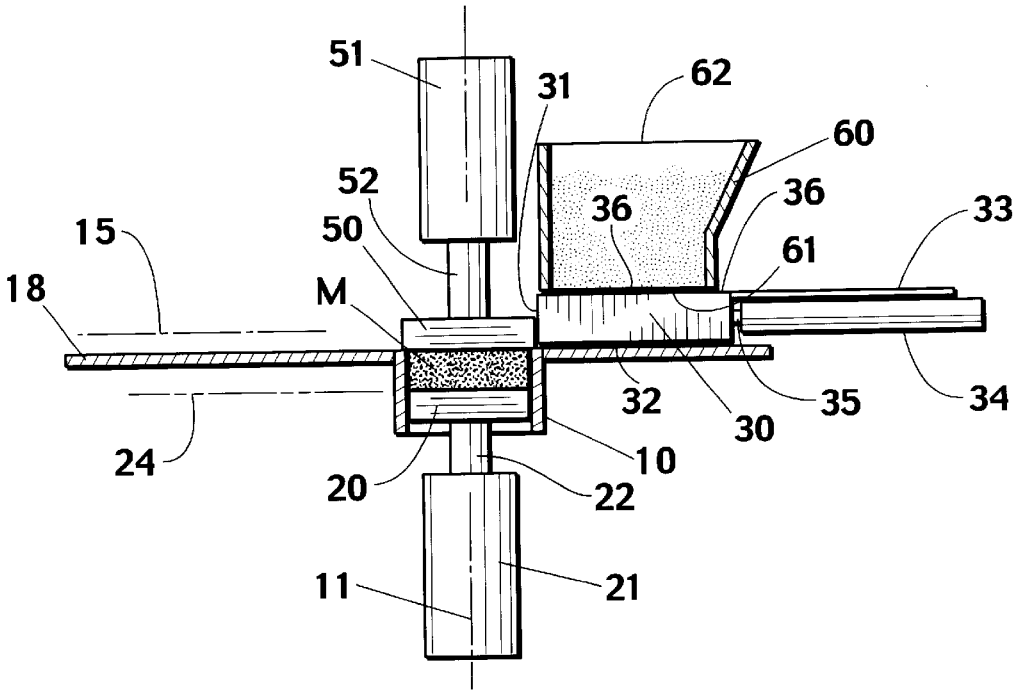
Figure 6:
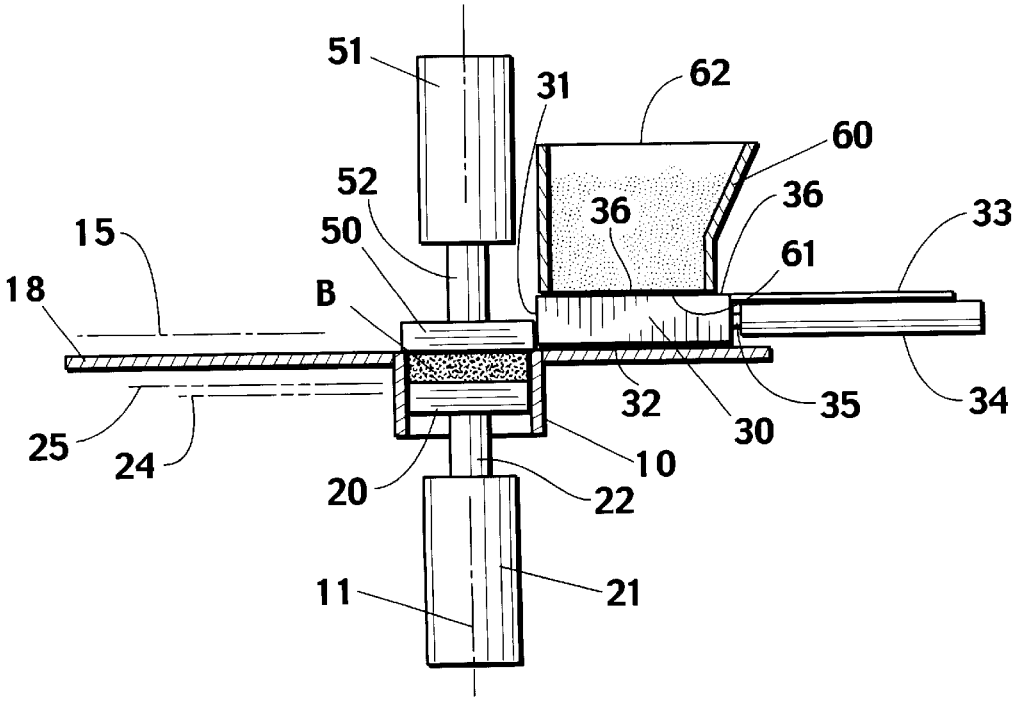
Figure 7:
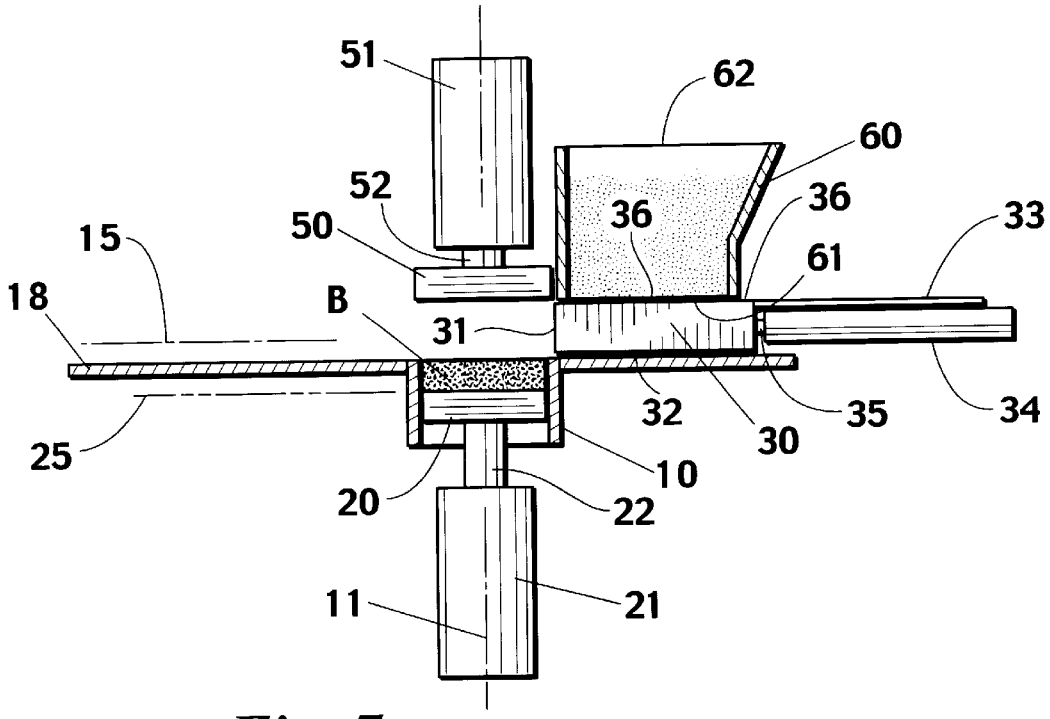
Figure 8:
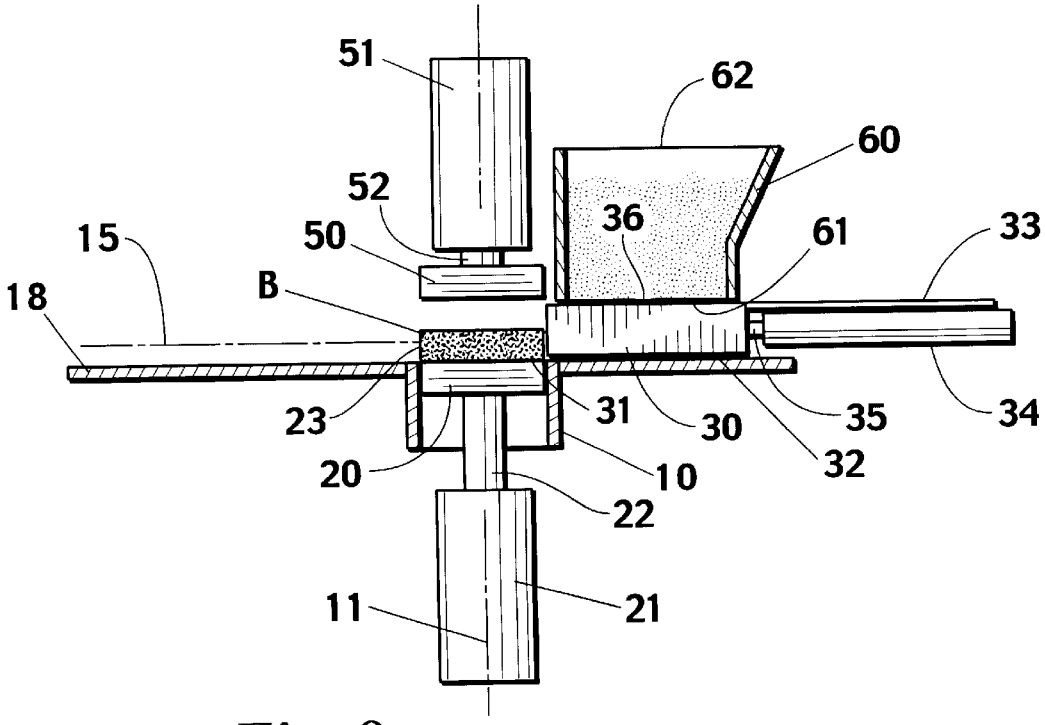

The operation of the machine is sequentially illustrated in FIGS. 1 through 8. Looking at FIG. 1, the press foot 20 is fully upwardly extended to a first level 23 which is coplanar with the planar surface 18 at the upper end of the breech 10. The feed drawer 30 is fully withdrawn into registration beneath the hopper 60 and the bucking foot 50 is fully raised to clear the path of lateral motion of the feed drawer 30. Assuming that no previous cycles of the machine have occurred, the block B shown by dotted lines in FIG. 1 is not present at the beginning of the first cycle of operation. Looking at FIG. 2, the feed drawer 30 has been fully extended out of registration with the hopper 60 and into registration with the breech 10. In this position, the open bottom 61 of the hopper 60 is closed by the trailing plate 33 on the feed drawer 30 and the open bottom 32 of the feed drawer 30 is closed by the planar surface 18 and the top of the press foot 20. Turning to FIG. 3, the press foot 20 is lowered to a second level 24 and loose earth M is dispensed from the drawer 30 into the breech 10. As shown in FIG. 4, the feed drawer 30 is then fully withdrawn from registration with the breech 10 and into registration with the hopper 60. The front end 31 of the feed drawer 30 screeds the excess loose earth M as it returns to its registration under the hopper 60. Looking at FIG. 5, once the feed drawer 30 is fully withdrawn, the path of the bucking foot 50 is clear and the bucking foot 50 is fully lowered onto the breech 10, closing the upper end of the breech 10. As shown in FIG. 6, the press foot 20 is then raised to a third level 25 above the second level 24 and compresses the loose earth M into a block B. The third level 25 is determined by preselection of the pressure to be exerted between the press foot 20 and the bucking foot 50 which will in turn be determined in relation to the desired density of the block B. After the block is formed, as shown in FIG. 7, the bucking foot 50 is fully withdrawn to its home position clearing the path of the feed drawer 30. Then, as shown in FIG. 8, the press foot 20 is returned to its first level 23 to position the block B in the path of the feed drawer 30. Going back to FIG. 1, during the next cycle of the machine, when the feed drawer 30 is moved into registration with the breech 10, the front end 31 of the feed drawer 30 will push the block B out of registration with the breech 10 to clear the breech 10 for the subsequent cycle. The block B can then be collected for delivery to its next destination.

Figure 10:
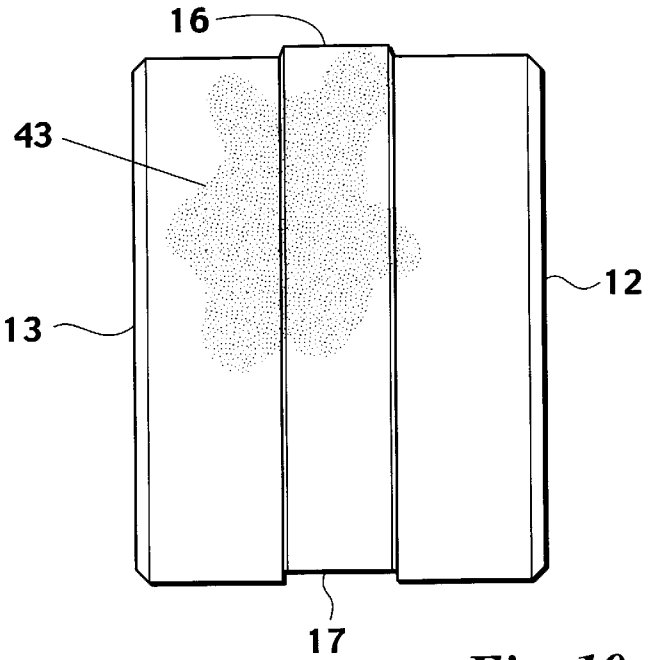
FIG. 10 is a top plan view of the block of FIG. 9.
Figure 11:
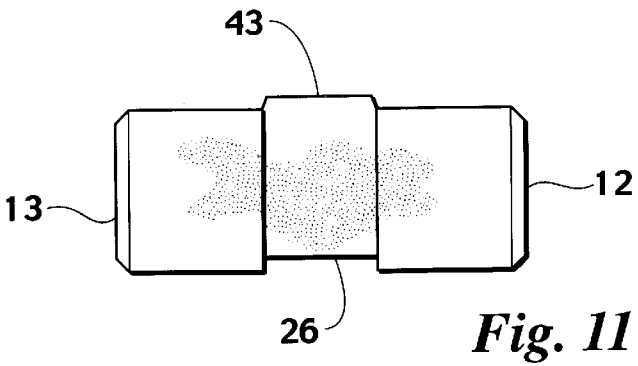
FIG. 11 is an end elevation view of the block of FIG. 9.
Figure 9:
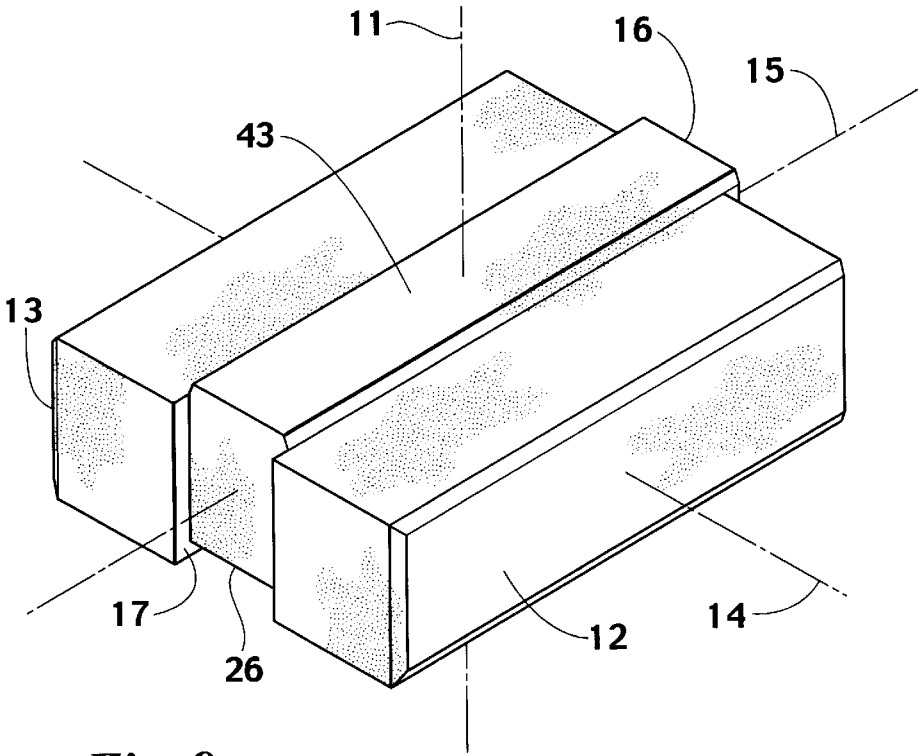
FIG. 9 is an isometric view of a preferred embodiment of a pressed earth block made in accordance with the machine and process of FIGS. 1 through 8.

Turning now to FIGS. 9 through 11, the configuration of the breech 10, the upper face of the press foot 20 and the lower face of the bucking foot 50 can be understood. It is, in many applications, desirable that the block B have a tongue-and-groove configuration both laterally and vertically to add strength to the assembled structure of blocks. Preferably, the lateral tongue-and-groove will be tapered to facilitate stacking of the blocks. To accomplish this, the breech 10 will have two dimensional surfaces 12 and 13 in its opposed Y-Z planes and will have complementary three dimensional surfaces 16 and 17 in its opposed X-Z planes. Thus, the X-Y cross-section of the breech 10 will define the lateral tongue-and-groove configuration of the block B. To provide the vertical tongue and groove configuration, the upper face of the press foot 20 and the lower face of the bucking foot 50 are complementary three-dimensional surfaces 26 and 43, respectively. As shown, it is preferred that the outer corners of the block B are beveled at approximately 45 degrees. To accomplish this, the upper face of the press foot 20 and the lower face of the bucking foot 50 are also contoured to provide this bevel. It is further desirable that the vertical tongue-and-groove of the block B be tapered at an angle of approximately 15 degrees-off-90 to facilitate engagement of sequential blocks and the upper surface of the press foot 20 and the lower surface of the bucking foot 50 are contoured for this purpose as well.

Figure 12:
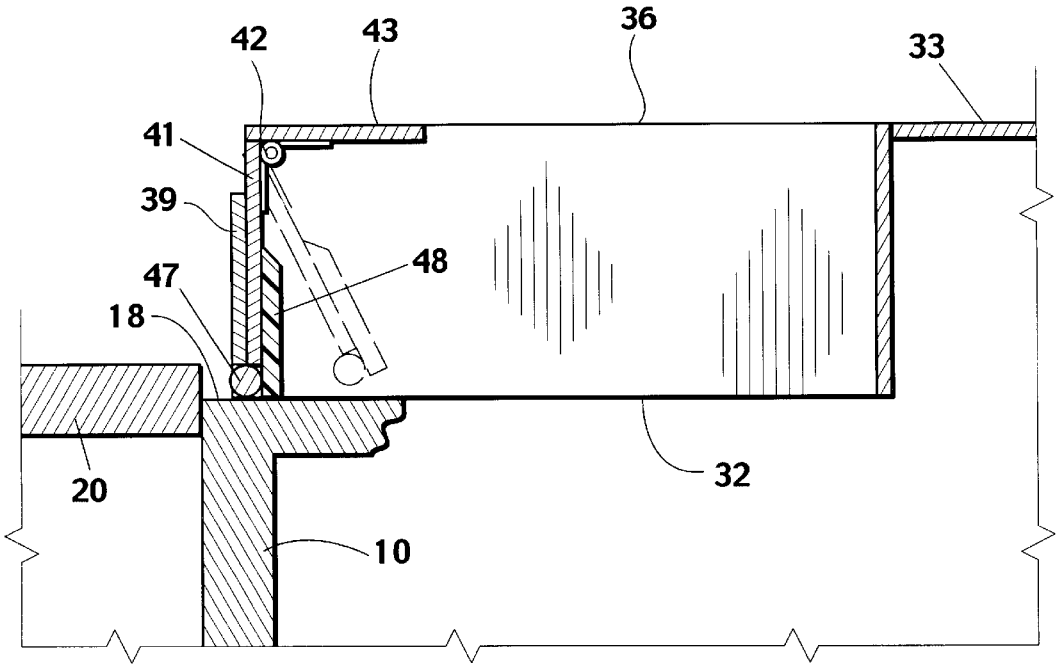
FIG. 12 is a side elevation view of a preferred embodiment of the feed drawer of the pressed earth block machine.
Figure 13:
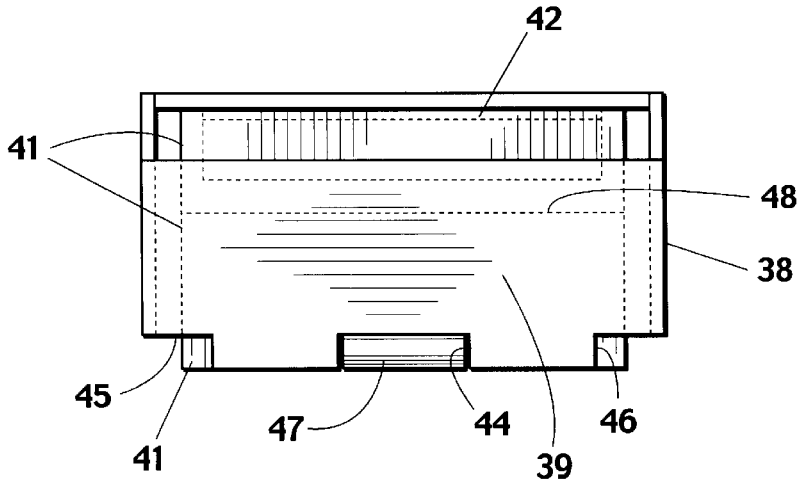
FIG. 13 is a front elevation view of the feed drawer of FIG. 12.

In making blocks B of a contoured lower face, the lower level of the three-dimensional surface will be parallel to the planar surface 18 as shown in FIGS. 1 through 8, so that the three-dimensional contour of the press foot 20 will extend above the planar surface 18 and the top of the breech 10. Thus, in order to facilitate the pushing of the block B off the press foot 20 by the front end 31 of the feed drawer 30 while also permitting the front end 31 of the feed drawer 30 to screed the planar surface 18 upon withdrawal of the feed drawer 30, the front end 31 of the feed drawer must be specially adapted. As shown in FIGS. 12 and 13, a push plate 39 is fixed to the forward ends of the side walls 37 and 38 of the feed drawer 30. As can best be seen in FIG. 13, the bottom edge of the push plate 39 is provided with notches 44, 45 and 46 as required to pass over and clear the three-dimensional surface of the press foot 20. A hinge plate 41 connected by a hinge 42 to a baffle 43 extending across the top forward portion of the feed drawer 30 is disposed in its normal condition with the hinge plate 41 in vertical alignment and following behind the push plate 39. The bottom edge of the hinge plate 41 is not notched. As the feed drawer 30 moves into registration over the breech 10, the lower edge of the hinge plate 41 strikes the three-dimensional portions of the upper face of the press foot 20 and the hinge 42. The hinge plate 41 rotates rearwardly so that the lower edge of the plate 41 will ride on the uppermost portion of the press foot 20. When the feed drawer 30 is withdrawn to registration with the hopper 60, the rearward motion of the feed drawer 30 together with the excess material already in the feed drawer 30 causes the hinge plate 41 to return to its normal vertical position to screed along the planar surface 18 during withdrawal. As shown, a section of round stock 47 may be secured at the bottom edge of the hinge plate 41 to facilitate the hinging motion of the plate 41 as it strikes the upper surface of the press foot 20. In addition, a wiper 48, preferably of nylon, is mounted across the lower inner surface of the hinge plate 41 for maximum screeding efficiency.

Figure 14:
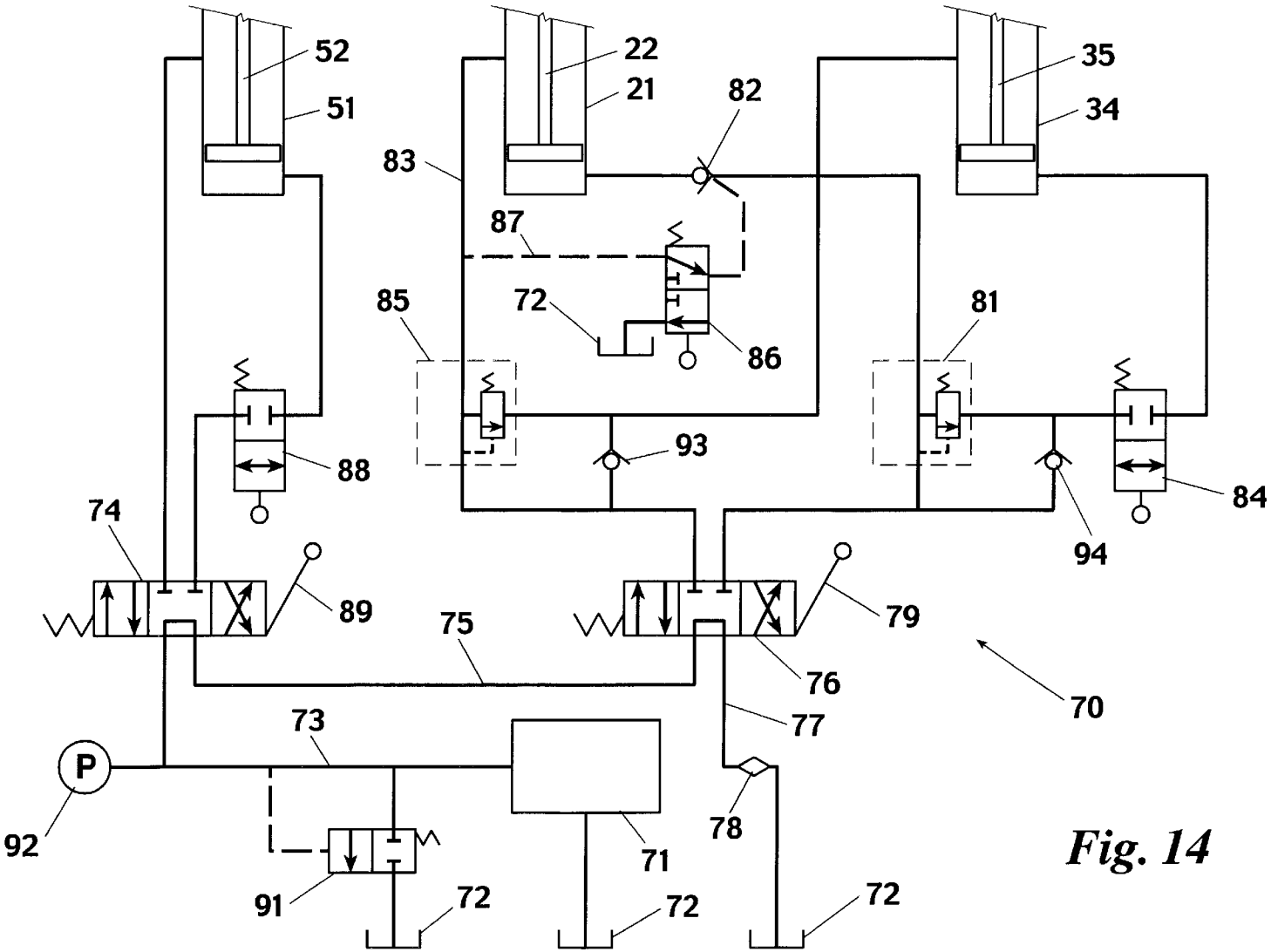
FIG. 14 is a schematic drawing of a preferred embodiment of the hydraulic system of the pressed earth block machine.

Turning now to FIG. 14, illustrating the hydraulic system 70 of the machine, the operation of the machine can be understood in greater detail. A two-stage pump 71 delivers hydraulic fluid from a reservoir 72 through a supply line 73 to a first four-way three-position lever operated valve 74 serving the bucking foot 50. The first lever operated valve 74 is series connected by a line 75 to a second four-way, three-position, lever operated valve 76 serving the press foot 20 and feed drawer 30 of the machine. From the second lever operated valve 76, fluid travels through a return line 77 and a filter 78 to the reservoir 72. With the lever operated valves 74 and 76 in their normal condition as shown, the pump 71 merely circulates fluid to the reservoir 72 and the other components of the hydraulic system 70 are idle. In this condition, when the operator pushes the lever 79 of the second lever operated valve 76, fluid is delivered through a sequence valve 81 and a check valve 82 to the press foot cylinder 21, driving the cylinder shaft 22 to fully raise the press foot 20 to its first level 23. Return fluid from the press foot cylinder 21 passes through the press foot return line 83. A two-way, two-position, cam operated valve 84 controls a second fluid path from the sequence valve 81 to the feed drawer cylinder 34. The cam operated valve 84 assures that fluid cannot flow to the feed drawer cylinder 34 unless the bucking foot 50 is in its fully withdrawn position clearing the path of the feed drawer 30. When the press foot 20 is at its first level 23, the sequence valve 81 switches to cause the feed drawer 30 to be fully extended into registration with the breech 10 of the machine. When the feed drawer 30 has reached its fully extended position, the operator pulls the lever 79 of the three position switch 76 back. With the lever 79 in this position, fluid flows through a second sequence valve 85 to the press foot cylinder 21 to lower the press foot 20 to its second level 24 to dispense loose earth M from the feed drawer 30 into the breech 10. A three-way, two-position, cam operated valve 86 is depressed to block the pilot line 87 in the press foot system and thus prevent further lowering of the press foot 20 beyond the second level 24. When the pilot line 87 is blocked, the three-way, two-position cam operated valve 86 vents back to the reservoir 72. When the three-way valve 86 cuts off, the second sequence valve 85 opens and allows the feed drawer cylinder 34 to vent and retract or withdraw the feed drawer 30 into registration with the hopper 60. When the feed drawer 60, is in registration with the hopper 60 a second two-way, two-position, cam operated valve 88 is depressed to allow the bucking foot 50 to be lowered. In this condition, the operator releases the lever 79 of the second lever operated valve 76 and pushes the lever 89 of the first lever operated valve 74 associated with the bucking foot 50. If the second two-way, two-position valve is depressed, the bucking foot cylinder 41 will be operated and the bucking foot 50 fully lowered to close the upper end of the breech 10. With the bucking foot 50 in this position, the operator releases the second lever 89 and once again pushes the first lever 79. This operates the press foot cylinder 21, causing the press foot 20 to be raised to its third level 25 in the breech 10. The third level 25 of the press foot 20 is determined by the selected pressure of a relief valve 91. When the block has been pressed, the operator releases the first lever 79 and pulls the second lever 89 to raise the bucking foot 50 to its fully retracted position. This automatically operates the first two-way, two-position, cam operated valve 84 and allows the cycle to be repeated. A pressure gauge 91 is provided to monitor the pressure at the relief valve 91 and check valves 93 and 94 complete the hydraulic circuit.

Thus, it is apparent that there has been provided, in accordance with the invention, a machine and method that fully satisfy the objects, aims and advantages set forth above. While the invention has been described in conjunction with specific embodiments and methods thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A method of making a block comprising the steps of:

raising a press foot within a breech to a first level even with an open upper end of the breech;

moving a feed drawer having an open lower end and filled with granular material laterally across a planar surface into registration over the breech;

lowering the press foot to a second level in the breech to receive a volume of the granular material from the feed drawer into the breech;

withdrawing the feed drawer laterally across the planar surface out of registration with the breech to remove excess granular material from above the open upper end of the breech;

lowering a bucking foot to close the upper end of the breech;

raising the press foot to a third level within the breech to compress the granular material in the breech into a block; and raising the bucking foot to a level higher than the top of the feed drawer and the block to permit ejection of the block from the open upper end of the breech into a path of the feed drawer.

2. A method according to claim 1:

said step of raising the press foot to the first level simultaneously inserting a previously-made block into a path of the feed drawer; and said step of moving the feed drawer laterally into registration over the breech simultaneously pushing the previously-made block out of a path of the bucking foot.

3. A method of making a block comprising the steps of:

raising a press foot within a breech to a first level even with an open upper end of the breech;

moving a feed drawer having open upper and lower ends and filled with granular material laterally across a planar surface into registration over the breech;

lowering the press foot to a second level in the breech to receive a volume of the granular material from the feed drawer into the breech;

withdrawing the feed drawer laterally across the planar surface out of registration with the breech to remove excess granular material from above the open upper end of the breech and to align the feed drawer under a hopper storing granular material;

dispensing additional granular material from the hopper to refill the feed drawer;

lowering a bucking foot to close the upper end of the breech;

raising the press foot to a third level within the breech to compress the granular material in the breech into a block; and raising the bucking foot to a level higher than the top of the feed drawer and the block to permit ejection of the block from the open upper end of the breech into a path of the feed drawer.

4. A method according to claim 3:

said step of raising the press foot to the first level simultaneously inserting a previously-made block into a path of the feed drawer; and said step of moving the feed drawer laterally into registration over the breech simultaneously pushing the previously-made block out of a path of the bucking foot.

5. A method of making a vertically and laterally tongue-and-groove block comprising the steps of:

raising a press foot having a three dimensional upper surface within a breech having complementary three dimensional opposite side surfaces to a first level even with an open upper end of the breech;

moving a feed drawer having open upper and lower ends and filled with granular material laterally across a planar surface into registration over the breech;

lowering the press foot to a second level in the breech to receive a volume of the granular material from the feed drawer into the breech;

withdrawing the feed drawer laterally across the planar surface out of registration with the breech to remove excess granular material from above the open upper end of the breech and to align the feed drawer under a hopper storing granular material;

dispensing additional granular material from the hopper to refill the feed drawer;

lowering a bucking foot having a three dimensional lower surface complementary to the upper surface of the press foot to close the upper end of the breech;

raising the press foot to a third level within the breech to compress the granular material in the breech into a block; and raising the bucking foot to a level higher than the top of the feed drawer and the block to permit ejection of the block from the open upper end of the breech into a path of the feed drawer.

6. A method according to claim 5:

said step of raising the press foot to the first level simultaneously inserting a previously-made block into a path of the feed drawer; and said step of moving the feed drawer laterally into registration over the breech simultaneously pushing the previously-made block out of a path of the bucking foot.

7. A method according to claim 6, said step of moving the feed drawer and simultaneously pushing the previously-made block being performed by abutment of a three dimensional face of the previously-made block with a leading face of the feed drawer.

8. A method of making a vertically and laterally tongue-and-groove block comprising the steps of:

raising a press foot having a three dimensional upper surface within a breech having complementary three dimensional opposite side surfaces to a first level even with an open upper end of the breech;

moving a feed drawer having open upper and lower ends and filled with granular material laterally across a planar surface into registration over the breech;

lowering the press foot to a second level in the breech to receive a volume of the granular material from the feed drawer into the breech;

withdrawing the feed drawer laterally across the planar surface out of registration with the breech to remove excess granular material from above the open upper end of the breech;

lowering a bucking foot having a three dimensional lower surface complementary to the upper surface of the press foot to close the upper end of the breech;

raising the press foot to a third level within the breech to compress the granular material in the breech into a block; and raising the bucking foot to a level higher than the top of the feed drawer and the block to permit ejection of the block from the open upper end of the breech into a path of the feed drawer.

9. A method according to claim 8:

said step of raising the press foot to the first level simultaneously inserting a previously-made block into a path of the feed drawer; and said step of moving the feed drawer laterally into registration over the breech simultaneously pushing the previously-made block out of a path of the bucking foot.

10. A method according to claim 9, said step of moving the feed drawer and simultaneously pushing the previously-made block being performed by abutment of a three dimensional face of the previously-made block with a leading face of the feed drawer.

* * * * *